United States Patent [19]

Hirosumi et al.

[11] Patent Number: 5,031,913

[45] Date of Patent: Jul. 16, 1991

[54] DICE GAME UNIT

[75] Inventors: Tamotsu Hirosumi; Tetsuya Abe, both of Chiba, Japan

[73] Assignee: Fuji Electronic Industry Co., Ltd., Chiba, Japan

[21] Appl. No.: 606,203

[22] Filed: Oct. 31, 1990

[30] Foreign Application Priority Data

Nov. 2, 1989 [JP] Japan ..... 1-286419

[51] Int. Cl.[5] ..... A63F 9/04

[52] U.S. Cl. ..... 273/145 C; 273/145 R; 273/138 A

[58] Field of Search ..... 273/145 CA, 145 C, 145 R, 273/145 D, 145 B, 146, 138 A, 114

[56] References Cited

U.S. PATENT DOCUMENTS

| | | | |
|---|---|---|---|
| 2,212,736 | 8/1940 | Hanley et al. | 273/145 R |
| 2,378,722 | 6/1945 | Nicholas | 273/145 R |
| 4,892,311 | 1/1990 | Zaitsu | 273/145 R |
| 4,909,513 | 3/1990 | Kiyono | 273/145 R |

OTHER PUBLICATIONS

Washington Post, "Radio Device has Dice Table Just Rolling in 7s", p. B1, Nov. 22, 1967.

*Primary Examiner*—Benjamin Layno

*Attorney, Agent, or Firm*—Venable, Baetjer, Howard & Civiletti

[57] ABSTRACT

A dice game unit for playing games by casting a die having a magnet mounted therein and adapted to indicate a particular number of spot(s) on the top thereof after being cast onto a game board arranged to generate a magnetic field. The game unit comprises a plunger for casting a die onto a game board; a plate for recovering the die which has been cast on the game board; a die receiver for receiving the recovered die; and a conveyor for conveying the dice. This dice conveyor is comprised of a belt which is wound around rollers and rotatively driven by a motor. The belt has die holding plates mounted at plurality of places thereon. Each of the die holding plates is arranged to be opened and closed so that it may seize a die from the die receiver.

8 Claims, 6 Drawing Sheets

DICE GAME UNIT

BACKGROUND OF THE INVENTION

1. Field of the Invention

This invention relates to an apparatus for playing dice games, and more particularly to a dice game unit for playing games by casting a die adapted to indicate a particular number of spot(s) on the top thereof after being cast onto a game board.

2. Description of the Prior Art

Dice games are usually conducted by a player by manually casting dice. As examples of the dice games, there are known dice poker for playing games by casting four to six pieces of dice, for example, onto a game board, and a game called "Big & Small" for playing games by casting two dice onto a game board.

U.S. Pat. No. 4,909,513 discloses an automatic playing machine for playing dice games such as dice poker by casting a plurality of dice each having a magnet mounted therein into a magnetic field, which is based on the principle that dice each having a magnet mounted therein are cast into a strong magnetic field and each of the dice indicates a predetermined number of spot(s) on the top thereof.

In the above-mentioned playing machine in which a plurality of dice are cast for playing games, the plurality of dice have to be controlled individually, the construction of the machine is complicated, and the operations of casting dice onto the game board to allow each of them to indicate a particular number of spot(s) on the top thereof and recovering them become complicated.

The present invention has been made in view of the above-mentioned circumstances and has for its object to provide a dice game unit for selecting one piece of die and casting it on a game board by a very simple mechanism.

SUMMARY OF THE INVENTION

To achieve the above-mentioned object, according to the present invention, there is provided a dice game unit for playing games by casting a die having a magnet mounted therein and adapted to indicate a particular number of spot(s) on the top thereof after being cast onto a game board arranged to generate a magnetic field, comprising means for casting a die onto a game board; means for recovering the die which has been cast on the game board; die receiver for receiving the recovered die; and means for conveying the dice, characterized in that said dice conveying means comprises a conveying member having holding plates mounted at plurality of places thereon, each of the die holding plates is arranged to be opened and closed so that it may seize a die from the die receiver According to the above-mentioned configuration, it is possible to hold on a game board a die having a magnet mounted therein and adapted to be controlled in posture in a magnetic field and to indicate a particular number of spot(s) on the top thereof after being cast, turn the belt and cast a die located at a particular position thereon onto the game board, and then recover the die again.

Therefore, a die adapted to indicate a predetermined number of spot(s) on the top thereof after being cast can be cast onto the game board.

The present invention will now be described by way of example only with reference to the accompanying drawings.

DETAILED DESCRIPTION OF PREFERRED EMBODIMENTS

Figure 1:
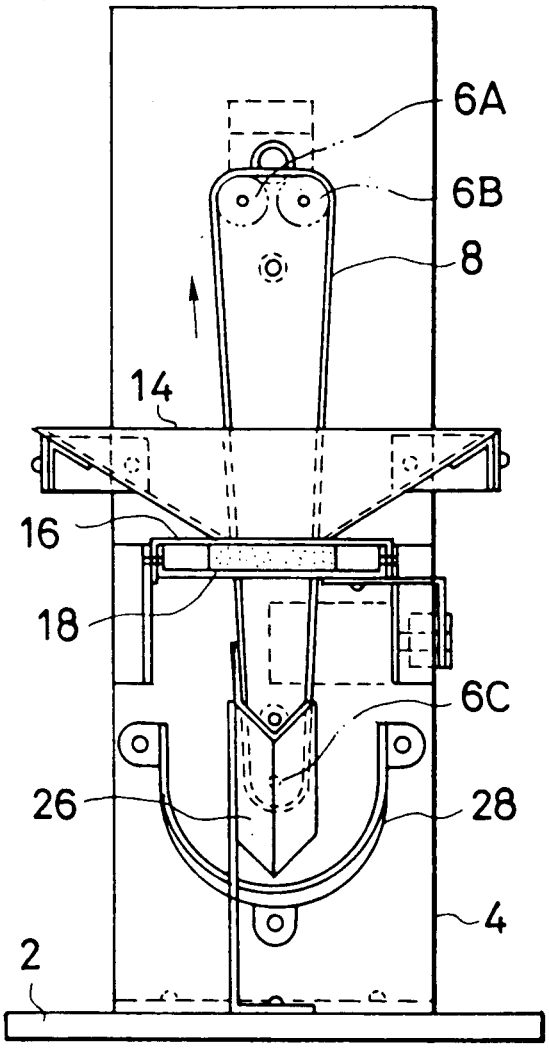
FIG. 1 is a front view showing the construction of one embodiment of the present invention.
Figure 2:
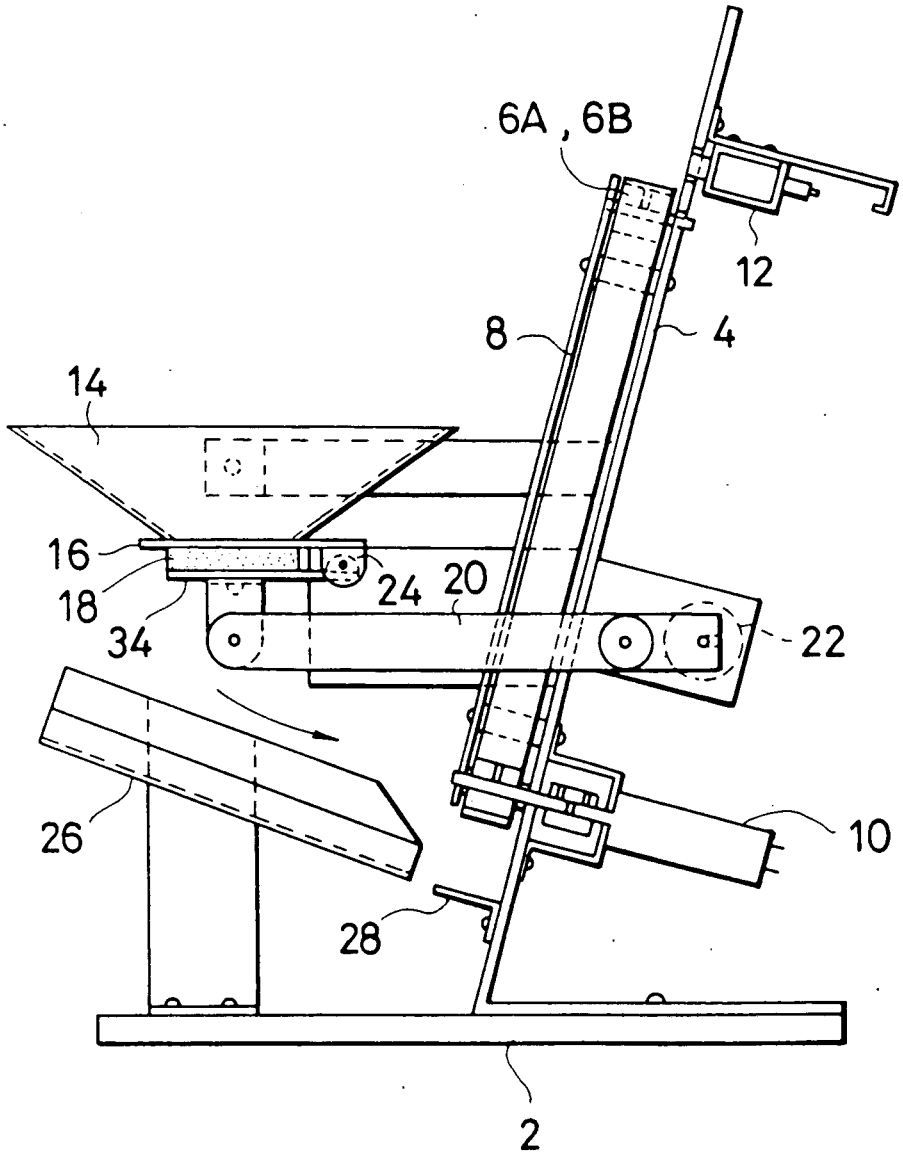
FIG. 2 is a side elevational view of the embodiment shown in FIG. 1.

FIGS. 1 and 2 show the overall construction of one embodiment of the present invention. FIG. 1 is a front view of the embodiment, and FIG. 2 is a side elevational view of the same. In the drawings, a support base 2 has a supporting plate 4 mounted thereon. A dice conveyor belt 8 is wound around rollers 6A, 6B and 6C mounted on the support plate 4 and is rotatively driven by a motor 10. Mounted on the support plate 4 above the rollers 6A, 6B installed in juxtaposition is a plunger 12 serving as a die casting means. While the plunger is used in this embodiment, the die casting means is not to be limited to this type, it is possible to cast a die onto a game board by pulling a spring actuated lever, or eject a die by turning the lever or by means of a mechanism in which the principle of leverage is applied.

A die ejected by the plunger 12 is cast into a game board 14 supported by the support plate 4. A bottom plate 16 is provided below the game board 14, and a magnet 18 is located under the bottom plate 16. Since the game board 14 is then applied with a magnetic field generated by the magnet 18 below the bottom plate 16, the die having a magnet mounted therein is controlled in posture and rests on the bottom plate 16 indicating a predetermined number of spot(s) on the top thereof.

The bottom plate 16 and the magnet 18 are connected through the intermediary of a crank member 20 to a motor 22 for die recovery purposes. The arrangement is made such that when the motor 22 for die recovery purposes is driven the bottom plate 16 and the magnet 18 are turned about a shaft 24 so as to drop the die resting on the bottom plate 16 and then returned to their original positions. While, in this embodiment, the bottom portion is arranged to be turned to drop the die, it may be slidably moved instead, or alternatively, an arrangement wherein a portion of the peripheral wall of the game board member 14 on the bottom plate is movable so as to drop the die may be utilized.

The die which has dropped will tumble along a die recovery guide 26 down onto a bowl-shaped die receiver 28.

FIGS. 3A–3D show the detailed construction of the dice conveyor belt 8 and the operation thereof. In FIGS. 3A–3D, the dice conveyor belt 8 is provided with die holding plates 30 at six places thereof, and each of the holding plates 30 can be opened and closed. The die holding plates 30 are adapted to hold six dice each having a magnet mounted therein, and being adapted to indicate a predetermined number of spot(s) from 1 to 6 under the influence of the magnetic field when each of them is cast on the game board 14. In FIGS. 3A to 3D, to make it easier to understand the operational principle, a die 32 adapted to indicate "one spot" on the top thereof after it is cast is illustrated showing "one spot" and being held by a holding plate 30A in FIG. 3(A). However, the number of spot(s) shown in the front view is not limited to one, and any of the number of spot(s) from 1 to 6 is acceptable.

Figure 3D:
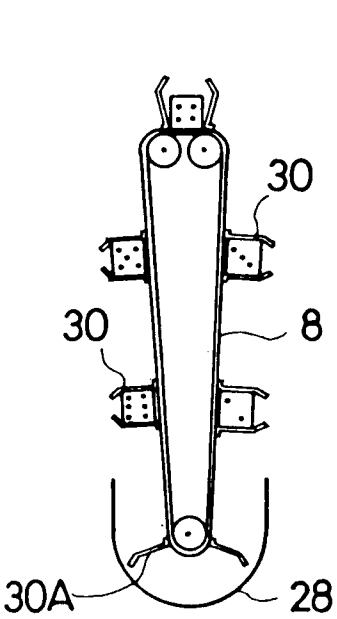
FIGS. 3(A) to 3(D) are explanatory views showing the operation of the dice conveying belt according to the present invention.
Figure 3C:
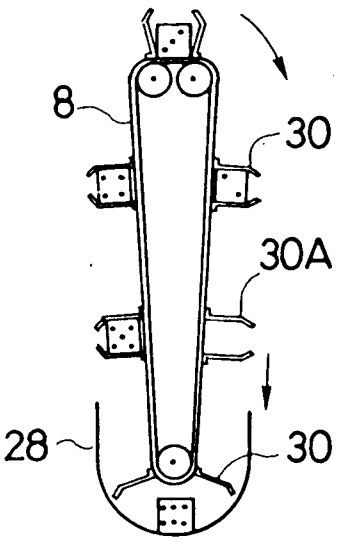
Figure 3B:
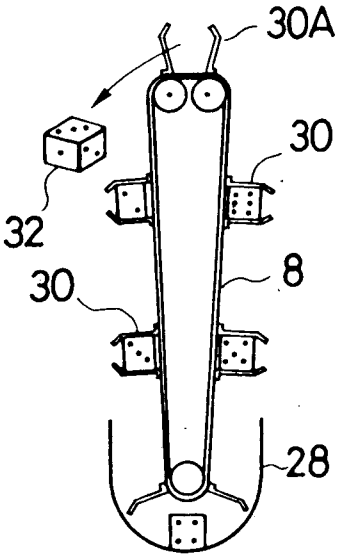
Figure 3A:
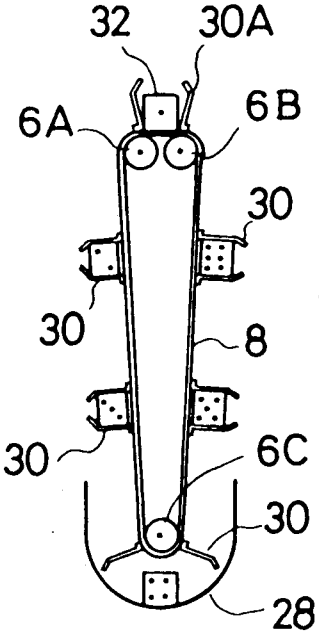

If, as shown in FIG. 3(A), the die 32 adapted to indicate "one spot" on the top thereof after being cast onto the game board is located at the uppermost position and the plunger 12 is supplied with electricity, then the die 32 is ejected by the plunger 12 as shown in FIG. 3(B) towards the game board 14 and rests thereon indicating "one spot" on the top thereof under the influence of the magnetic field applied to the game board 14, as aforementioned. With further rotative movement of the dice conveyor belt 8, the holding plate 30A which was holding the die 32 will go through the condition as shown in FIG. 3(C) and stop at a position opposite to the die receiver 28 and open fully to facilitate the recovery of the die 32 and stand by, as shown in FIG. 3(D).

Figure 4:
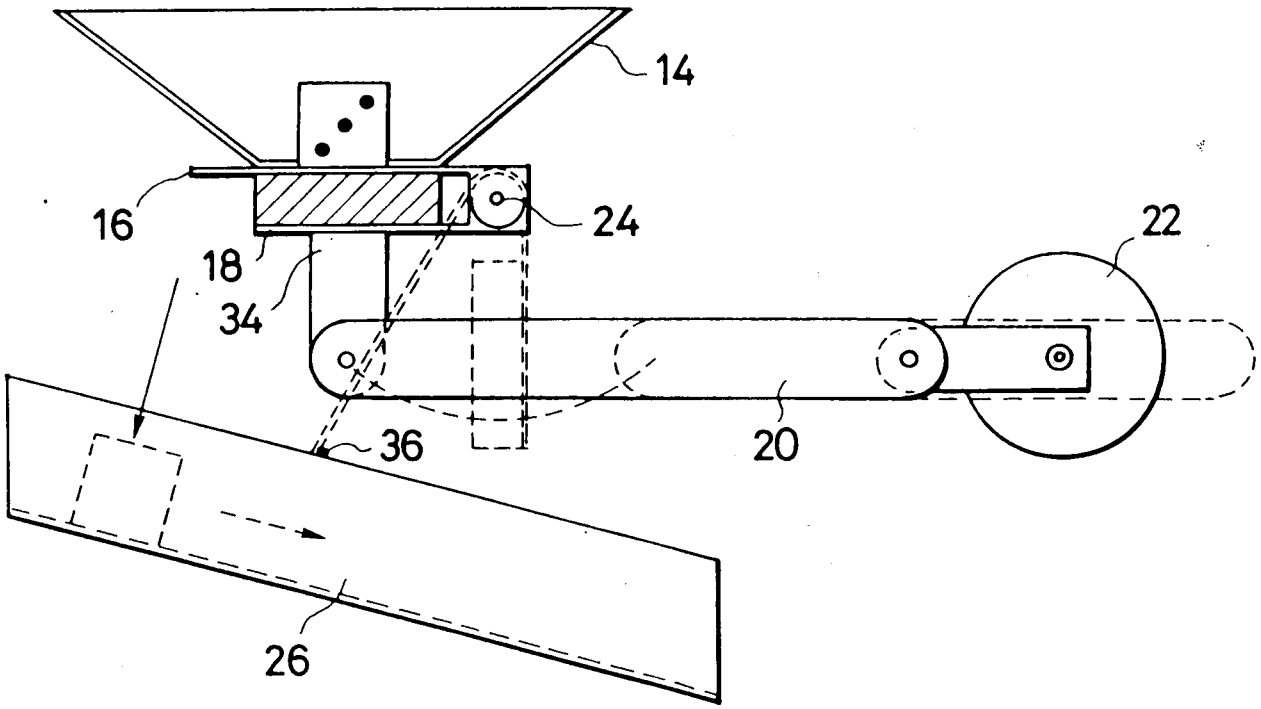
FIG. 4 is a side elevational view showing a recovery mechanism of this embodiment.

Next, a die recovery means will be described with reference to FIG. 4. The bottom plate 16 rests on the magnet 18 which is mounted on a magnet mounting plate 34. The bottom plate 16 and the magnet mounting plate 34 are pivotally mounted on the shaft 24 so that they may be turned independently. The magnet mounting plate 34 is connected to and hold by the die recovery motor 22 through the intermediary of the crank member 20.

When the die recovery motor 22 is energized, the magnet mounting plate 34, the magnet 18 mounted thereon and the bottom plate 16 resting on the magnet 18 are turned as an integral unit about the shaft 24 by the horizontal movement of the crank member 20, which is caused by rotation of the motor 22, the die 32 on the bottom plate 16 will drop since the turning radius of the bottom plate 16 is larger than those of the magnet 18 and the magnet mounting plate 34, the turning of the bottom plate 16 is stopped by a stopper 36 secured fixedly to the die recovery guide 26, whilst the magnet 18 and the magnet mounting plate 34 keep turning. As a result, the influence of the magnetic field applied by the magnet 18 onto the die 32 will reduce so that the die 32 will drop smoothly on the die recovery guide 26.

Further, while a variety of systems for stopping the dice conveyor belt 8 at a designated position can be envisaged, the following system is used in this embodiment.

Figure 5:
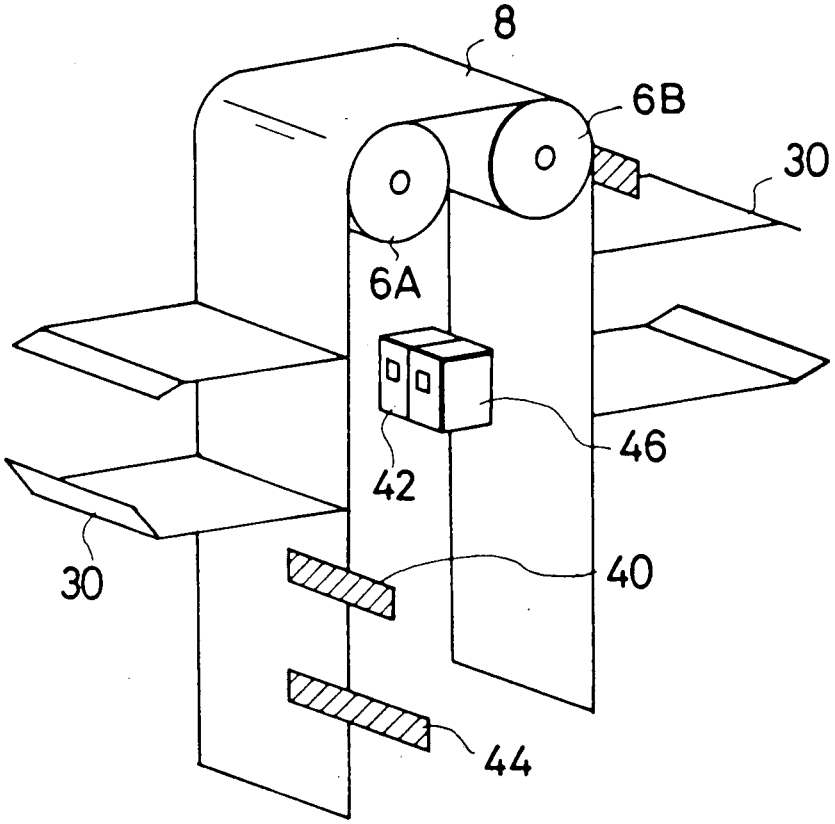
FIG. 5 is a perspective view showing sensor units of this embodiment.

As shown in FIG. 5, the dice conveyor belt 8 has die selective reflector plates 40 mounted thereon, each of which is located at a predetermined, fixed position from each of the holding plates 30. The arrangement is made such that by stopping the dice conveyor belt 8 when the die selective reflector plate 40 has traversed the sensor 42 the die holding plate 30 can be stopped either at the uppermost position or at the lowermost position.

In order to find out which die holding plate 30 is holding a die adapted to indicate a particular number of spot(s) on the top thereof after being cast, a reference point reflector plate 44, which is longer than the die selective reflector plates 40, is mounted at one place on the dice conveyor belt 8, and a sensor 46 for detecting the reference point reflector plate 44 is installed in juxtaposition to the sensor 42. According to such arrangement, since the reference point reflector plate 44 traverses the sensors 42, 46, which are of reflection type photosensors, at the same time, the location of the reference point can be detected. Thus, if the number of times of outputs generated by the sensor 42 when it is traversed by the die selective reflector plates 40 after the detection of the reference point reflector plate 44 is known, then the dice conveyor belt 8 can be stopped when a die adapted to indicate a designated number of spot(s) on the top thereof after being cast is located either at the die casting position or at the die receiving position.

It is of course possible to store in the storage unit of a computer the distances from the reference point to the individual die holding plates 30 and detect the reference point by the sensor 46 so as to control the position where each of the holding plates 30 is stopped.

According to this embodiment, it is possible to cast a predetermined die onto the game board and indicate a predetermined number of spot(s) on the top thereof.

In the next place, a dice game unit "Big & Small" using two sets of this embodiment of the present invention will be described. The game unit "Big & Small" is used for playing games to guess the sum of the number of spot(s) appearing on the top of two dice after being cast on a game board is larger or smaller than 7. If the sum is 7, the player loses a game. The following rule is established to give enjoyment to games.

RULE 1

| | | APPEARING PATE | EXPECTED VALVE |
|---|---|---|---|
| (1) In case the sum is smaller than 7 and both dice indicate "1" and "1" | odds 4 | 0.0278 | 0.1112 |
| (2) In case the sum is smaller than 7, excepting the above case | odds 2 | 0.3889 | 0.7778 |
| (3) In case the sum is "7" | — | 0.1666 | — |
| (4) In case the sum is bigger than 7, excepting "6" and "6" | odds 2 | 0.3889 | 0.7778 |
| (5) In case both dice indicate "6" and "6" | odds 4 | 0.0278 | 0.1112 |

Two betting places "Big" and "Small" are provided. Therefore, the pay-off rate when the sum of the number of spot(s) indicated on the two dice is 0.8889. If the player bets "Big" and both dice indicate "6" and "6", respectively, four times a bet is paid to the player. If the player bets "Big" excepting "6" and "6", two times a bet is paid to the player.

RULE 2

In case both dice indicate "1" and "1", "2" and "2", . . . "6" and "6", odds are set at 3.

| | | APPEARING PATE | EXPECTED VALVE |
|---|---|---|---|
| (1) In case the sum is smaller than 7 and both dice indicate "1" and "1", "2" and "2", or "3" and "3" | odds 3 | 0.0833 | 0.2499 |
| (2) In case the sum is smaller, excepting the above case | odds 2 | 0.3333 | 0.6666 |
| (3) In case the sum is "7" | — | 0.1667 | — |

-continued

| | | APPEARING PATE | EXPECTED VALVE |
|---|---|---|---|
| (4) In case the sum is bigger than 7, excepting the following case | odds 2 | 0.3333 | 0.6666 |
| (5) In case the sum is bigger than 7 and both dice indicate "4" and "4", "5" and "5" or "6" and "6" | odds 3 | 0.0833 | 0.2499 |

The pay-off rate when the sum is smaller or bigger than 7 is 0.9165.

RULE 3

This game is called "Snake Eyes", and there are provided three betting buttons, "Big", "Small" and "Snake Eyes" (in case both dice indicate "1" and "1", respectively). But, the player is allowed to bet one of the three places. In case the Snake Eye ("1" and "1") appears, 30 times as much as a bet is paid to the player. The pay-off rate when the sum is smaller or bigger than 7 is 0.8334.

As mentioned above, a variety of rules can be envisaged.

Figure 6:
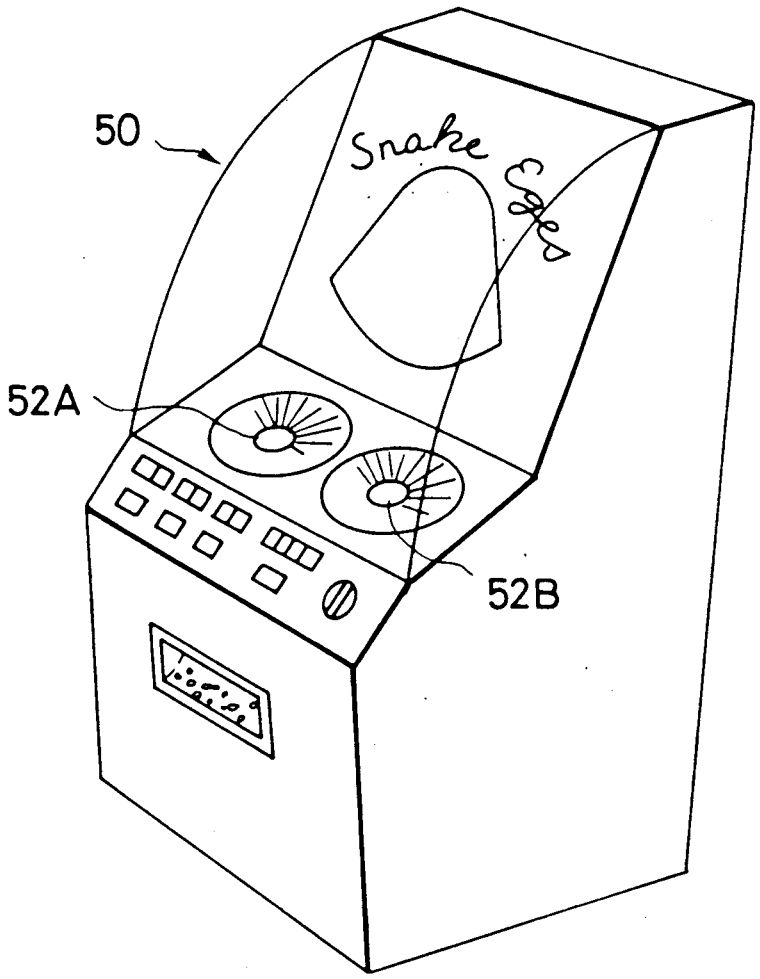
FIG. 6 is a perspective view showing an example of the playing machine using this embodiment.

FIG. 6 is a perspective view showing a game machine "Snake Eyes" 50. Two game boards 42A and 52B, in each of which a die is cast, are designed like eyes of a snake. The spot of "1" on each of dice is indicated in bigger size and in red with a fluorescent paint.

As mentioned hereinabove, according to the present invention, it is possible to control the number of spot(s) appearing on the top of a die after being cast onto the game board by a simple mechanism. Therefore, a variety of games using dice can be devised.

It is to be understood that the foregoing description is merely illustrative of preferred embodiments of the present invention, and that the scope of the present invention is not to be limited thereto, but is to be determined by the scope of the appended claims.

What is claimed is:

1. A dice game unit using dice each having a magnet mounted therein and adapted to indicate a predetermined number of spot(s) on the top thereof after being cast on a game board, comprising:

a game board having a bottom plate and a magnet which are mounted underneath and arranged to generate a magnetic field thereon so that a die which has been selected and cast thereon may come to standstill, indicating a particular number of spot(s) on the top thereof;

means for casting said die onto said game board;

means for recovering the die which has been cast on said game board:

a die receiver for receiving the recovered die;

a plurality of die holding plates, each of which is adapted to hold a die and which are opened and closed to seize the die on said die receiver: and means for conveying dice between said die casting means and said die receiver.

2. A dice game unit according to claim 1, wherein said dice conveyor means comprises a belt which is wound round rollers provided near said die casting means and near said die receiver, and which is rotatively driven by a motor.

3. A dice game unit according to claim 1, wherein the bottom plate of said game board is movable and said recovery means comprises a driver unit for moving the bottom plate so as to discharge the die, and a die recovery guide for guiding the discharged die into said die receiver.

4. A dice game unit according to claim 1, wherein said die recovery means comprises a die discharging member provided on said bottom plate and a driver unit for actuating the discharging member, and the recovery guide for guiding the discharged die into said die receiver.

5. A dice game unit according to claim 1, wherein said die casting means is arranged to eject a die held by said die holding plate by means of a plunger provided at a predetermined position.

6. A dice game unit according to claim 1, wherein said belt is provided with a reference point and a sensor for detecting the reference point and generating a signal to stop said belt when it has been moved by a predetermined distance after the reference point is detected by means of a sensor.

7. A dice game unit using dice each having a magnet mounted therein and adapted to indicate a particular number of spot(s) on the top thereof, after being cast on a game board, comprising:

a support member;

a game board supported on the intermediate portion of the support member and having a bottom plate and a magnet, which are mounted underneath so as to be turned freely, and arranged to generate a magnetic field thereon so that a dee which has been selected and cast thereon may come to standstill indicating a particular number of spot(s) on the top thereof;

means provided on the upper portion of said support member so as to cast said predetermined die onto the game board;

a cup-shaped die receiver provided on the lower portion of said support member;

means for turning said bottom plate so as to discharge the die which has been cast on the game board and recovering it into said die receiver;

first roller means provided near the die casting means of said support member;

second roller means provided near the die receiver; and pg,17 dice conveyor means having a belt wound around said first and second roller means and adapted to be rotatively driven by a motor, said belt having holding plates mounted at plurality of places thereon, each of the holding plates being adapted to hold a die and arranged to be opened and closed to seize the die from said die receiver.

8. A dice game unit according to claim 7, wherein said dice conveyor belt has die selective reflector plates mounted a thereon, each of which being located at a predetermined distance from each of the individual die holding plates, and has also a reference point reflector plate mounted at one place thereon, and sensors for detecting the position of said selective reflector plates and the position of the reference point reflector plate, respectively, are provided to detect a die adapted to indicate a particular number of spot(s) and stop said dice conveyor belt at predetermined positions.

* * * * *